US007731646B2

(12) United States Patent
Leighton

(10) Patent No.: US 7,731,646 B2
(45) Date of Patent: Jun. 8, 2010

(54) METHOD OF AND APPARATUS FOR SEALING ZIPPER TO A SUBSTRATE

(75) Inventor: Murray Edward Bruce Leighton, Yorkshire (GB)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/088,042

(22) PCT Filed: Jul. 5, 2001

(86) PCT No.: PCT/GB01/02968

§ 371 (c)(1),
(2), (4) Date: Jul. 11, 2002

(87) PCT Pub. No.: WO02/06040

PCT Pub. Date: Jan. 24, 2002

(65) Prior Publication Data

US 2002/0173414 A1 Nov. 21, 2002

(30) Foreign Application Priority Data

Jul. 15, 2000 (GB) ..... 0017307.0

(51) Int. Cl.
*B31B 1/90* (2006.01)

(52) U.S. Cl. ..... 493/213; 493/212; 493/215; 53/133.4; 53/139.2

(58) Field of Classification Search ..... 493/212, 493/213, 214; 53/139.2, 133.4
See application file for complete search history.

(56) References Cited

U.S. PATENT DOCUMENTS 4,709,533 A * 12/1987 Ausnit ..... 53/451
5,276,950 A 1/1994 Johnson ..... 24/587
5,417,035 A * 5/1995 English ..... 53/412
5,519,982 A * 5/1996 Herber et al. ..... 53/412
5,573,614 A * 11/1996 Tilman et al. ..... 156/66
5,592,802 A * 1/1997 Malin et al. ..... 53/133.4
5,638,586 A 6/1997 Malin et al. ..... 24/587
5,769,772 A * 6/1998 Wiley ..... 493/189
5,904,425 A * 5/1999 May ..... 383/203
6,017,412 A * 1/2000 Van Erden et al. ..... 156/290
6,044,621 A * 4/2000 Malin et al. ..... 53/412
6,085,491 A 7/2000 Bois ..... 53/412
6,099,451 A * 8/2000 Mulder et al. ..... 493/214
6,212,857 B1 * 4/2001 Van Erden ..... 53/412
6,244,021 B1 * 6/2001 Ausnit et al. ..... 53/412

(Continued)

FOREIGN PATENT DOCUMENTS

EP 0 982 117 A2 3/2000

(Continued)

*Primary Examiner*—Christopher Harmon
(74) *Attorney, Agent, or Firm*—Woodcock Washburn LLP

(57) ABSTRACT

A reclosable fastener (10) comprising a two-part body and a single flange (16) is located between two webs (34) of material from which a bag is to be made on a form-fill-seal machine. The fastener is attached initially to the inside of one web (34) by the flange (16). The combination passes between sealing jaws (44) to seal the webs to the fastener at thickened zones (30) at the margins of the body By making the body compact, and by using sealing jaws (44) which are longer than the body, the webs (34) form around the ends of the fastener body.

5 Claims, 1 Drawing Sheet

U.S. PATENT DOCUMENTS 6,327,837 B1 * 12/2001 Van Erden ..... 53/412
6,357,914 B1 * 3/2002 Kinigakis et al. ..... 383/64
6,386,760 B1 * 5/2002 Tomic ..... 383/5
6,393,804 B1 * 5/2002 Ausnit ..... 53/412
6,526,726 B1 * 3/2003 Strand et al. ..... 53/412
6,688,079 B2 * 2/2004 Kinigakis et al. ..... 53/412
6,688,080 B2 * 2/2004 Kinigakis et al. ..... 53/412

FOREIGN PATENT DOCUMENTS

WO WO 98/49062 11/1998

* cited by examiner

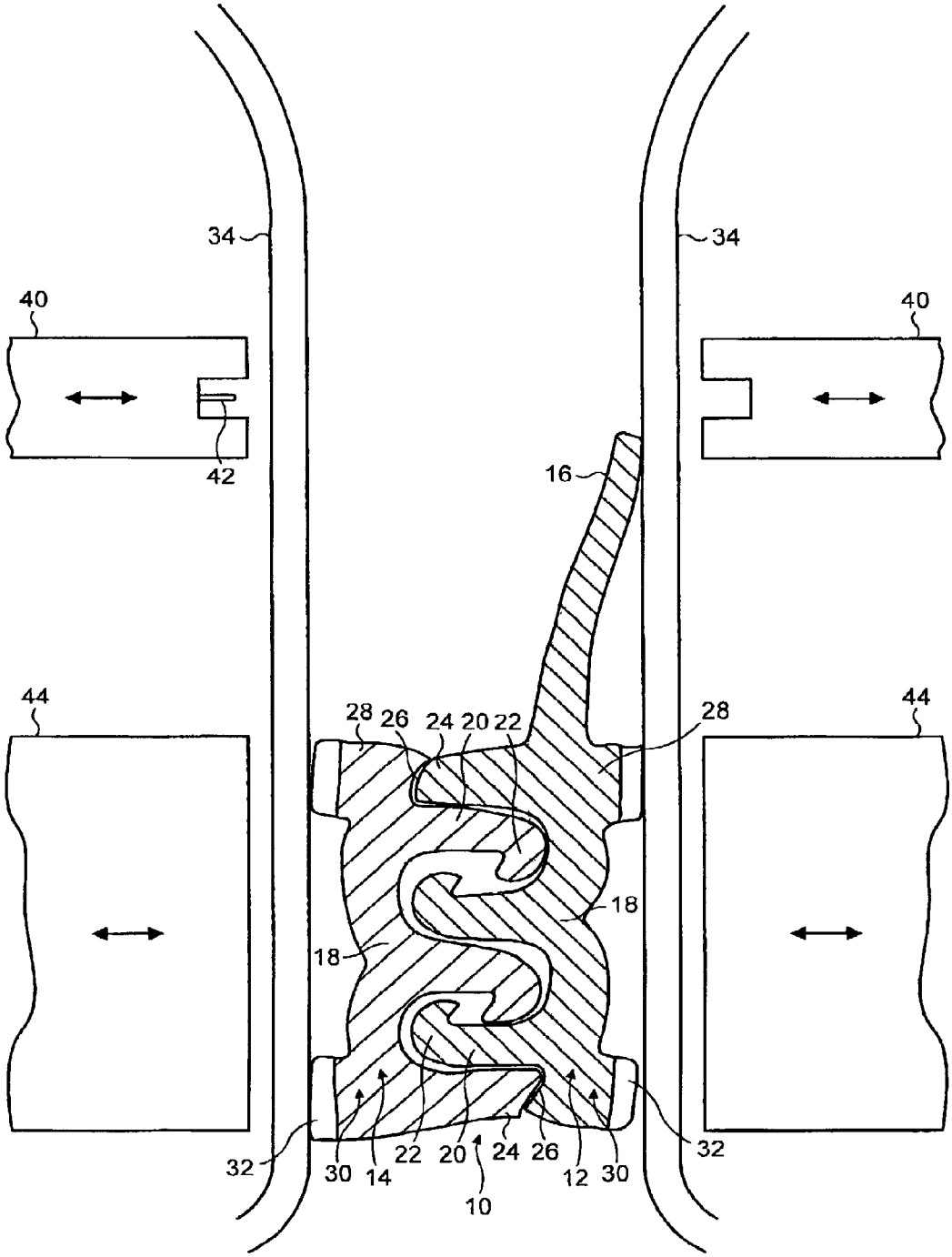
34
34
40
40
42
16
44
44
28
26
24
20
22
28
18
18
32
32
30
14
22
20
24
26
12
30
10

METHOD OF AND APPARATUS FOR SEALING ZIPPER TO A SUBSTRATE

FIELD OF THE INVENTION

This invention relates to methods of and apparatus for sealing reclosable fasteners, otherwise know as zippers, to a web or film, in the manufacture of plastics bags and other containers.

The invention is particularly concerned with the sealing of zippers on form/fill/seal machines, vertical or horizontal, and more especially where the zipper is applied to the substrate using cross-web techniques.

BACKGROUND TO THE INVENTION

When a zipper strip is applied to a film or web, heat and pressure are applied to effect the welding of the zipper to the film or web. The heat and/or the pressure can result in damage to the closure. Various measures have been adopted to try to minimise the effects of the heat and pressure. For example, the welding can be of flanges extending laterally from the reclosable male and female elements, to try to minimise damage to the closure. However, it can still happen that the zipper is damaged or distorted as a result of these external influences.

Our international patent application WO-A-02/04298 describes a novel zipper whose design is resistant to distortion or damage due to the welding heat and/or pressure.

In that application there is described a reclosable fastener for plastic bags and other containers comprising two elements, each element comprising at least one hook engageable with a hook of the other element, and each element comprising an upstanding post at the margin of the fastener which is engageable with a heel of the other element at the opposing margin of said other element, wherein the respective posts and heels of the two elements are angled at their respective contact surfaces.

The fact that the respective contact surfaces of the posts and heels are angled or mitred enables the closure more easily to resist pressure without distortion and without the hooks being squashed. The margins of the closure are more easily able to resist bending and to maintain their desired supporting function.

SUMMARY OF THE INVENTION

In accordance with the present invention there are provided methods of and apparatus for sealing such a zipper to a substrate by the use of sealing jaws.

In accordance with the invention there is provided a method of sealing a reclosable fastener to a substrate which comprises presenting lengths of fastener to a continuous substrate, locating the lengths of fastener on the substrate by attaching them to the substrate so as to leave a body of the fastener free for movement, and passing the combination between a pair of sealing jaws which are dimensioned to be longer than the body of the fastener along the path of movement of the combination and which are displaceable relative to the combination to effect a sealing of the substrate to the fastener body when moved into contact therewith.

Preferably, the length dimension of the sealing jaws is such as to form the substrate around the body of the fastener.

A preferred embodiment of the method includes locating the fastener between two substantially parallel webs of material, and initially attaching the lengths of fastener only to the inside of one of said webs of material.

With the method of the present invention the sealing of the full zipper profile to the substrate is effected within the jaw area. This is in contrast to other known methods where zipper flanges only are sealed to the substrate in this area.

In a preferred embodiment, the body of the fastener comprises two engageable elements, each having an upstanding post at the margin of the fastener which is engageable with a heel of the other element at the opposing margin of said other element, with the respective posts and heels of the two elements being angled at their respective contact surfaces.

An advantage of this method is that because of the zipper design, with the mitred posts and heels, and the consequent resistance to distortion, a smaller zipper profile can be used and the bars of the sealing jaws can be relatively large. The relatively small height of the profile and the use of gripper bars means that the web or film forms around the zipper profile and does not cause heat marks on the web or film. This allows a greater degree of bag length variation in the host unit.

Also in accordance with the invention there is provided apparatus for sealing a reclosable fastener to a substrate, comprising means for presenting lengths of fastener to a continuous substrate, means for attaching the lengths of fastener initially to the substrate so as to leave a body of the fastener free for movement, and a pair of sealing jaws between which the combination is arranged to pass, said jaws being dimensioned to be longer than the body of the fastener along the path of movement of the combination and being displaceable relative to the combination to effect sealing of the substrate to the fastener body when moved into contact therewith.

BRIEF DESCRIPTION OF THE DRAWING

In order that the invention may be more fully understood, one presently preferred embodiment of method and apparatus in accordance with the invention will now be described by way of example and with reference to the accompanying drawing which is a schematic cross-sectional view through the apparatus and zipper.

DESCRIPTION OF THE PREFERRED EMBODIMENT

Referring to the drawing, there is shown a zipper, indicated generally at 10, comprising a first element 12 and a second element 14. The two elements 12 and 14 are generally the same as each other, apart from the fact that element 12 is provided with a single elongate flange 16. Each element 12, 14 comprises a body portion 18 with two upstanding legs 20 which terminate in hooks 22. The respective hooks 22 of the two elements 12 and 14 are interengageable to make the reclosable fastener.

Each element 12, 14 also comprises an upstanding support post 24 at one margin. The support post 24 is slightly longer than the hooked legs 20, 22 so that it extends slightly beyond the tops of the legs. The upper end surface 26 of each post 24 is tapered to provide an angled contact surface. Facing each support post 24, on the opposing element, there is provided a heel portion 28, again at the margin. The surface of each heel portion 28 facing the respective post 24 is shaped to be complementary to the angled contact surface 26. As can be seen from the drawing, with this arrangement, the respective posts and heels nest with one another to provide a shape-locking configuration which tends to resist squashing or outward bending under applied load. The angled contact surfaces are able to absorb the welding pressure and maintain their linear integrity, thus preventing the hooked legs 20, 22 from being squashed or distorted.

In order to reduce the effects of the welding heat, each of the closure elements 12 and 14 is provided with a pair of thickened areas 30 on the outside face remote from the legs 20. The respective thickened areas 30 are again provided at the margins of the closure, in alignment with the posts 24 and heel portions 28. The thickened areas 30 are provided by a thickening of the material of which each of the two elements is composed. Because of the additional bulk provided by the thickened areas 30, they also contribute to the resistance of the closure to deformation due to pressure. On each thickened area 30 there is provided a layer 32 of a material which is a high-performance sealing/welding material or blend of materials, such as EVA for example. This facilitates the welding of the zipper to an adjacent web or film 34. The layers 32 are co-extruded with the closure elements 12 and 14.

The single long flange 16 which is part of element 12 is arranged to face and be attached to the inside of the web or film 34 on one side of the bag. The zipper comprising a body and a single flange is located by a cross-web technique at the correct position between two continuous webs 34 of material.

In the method of manufacturing a plastics bag or other container on a form-fill-seal (FFS) machine, lengths of zipper 10 are presented to and located between two continuous webs or films 34 by a cross-web technique and initially are welded just by the single flange 16 to the inside surface of one web 34, leaving the body of the zipper free for movement. The partially formed bag carrying the zipper strip then passes through a first pair of reciprocating sealing jaws 40, one of which incorporates a knife blade 42 whose purpose is to sever the filled and sealed bags.

Following the jaws 40 is a second pair of sealing jaws 44, at least one of which, and preferably both, is displaceable towards and away from the path along which the partially formed bag travels. The jaws 44 are relatively large and the zipper 10 is relatively small and compact. The length dimension of the jaws 44 in the direction of movement of the zipper/substrate combination is longer than the body of the zipper. Therefore, the film 34 forms around the ends of the zipper profile when the sealing jaws 44 move inwards, without causing heat marks on the film.

The jaws 44 may be of any suitable design and form. They can for example be of the type described in our International patent application WO O1/28759 where each jaw has a plurality of spaced heat sealing wires, with a plurality of pressure switches associated with the wires and operable when pressure is imparted thereto to heat the wires. Alternatively, they can be flat-surface jaws heated by appropriate means. The welding of the film 34 to the zipper is effected by a suitable combination of the parameters of heat, pressure and time.

The invention claimed is:

1. A method of sealing lengths of reclosable fastener to a continuous elongate substrate at spaced predetermined intervals along the length of said substrate, said method comprising:

(a) providing said continuous elongate substrate;

(b) presenting lengths of fastener to said continuous elongate substrate at said predetermined intervals along said length of said substrate, said lengths of fastener each extending transversely to the length of said substrate, said lengths of fastener each comprising:

a body portion; and a flange portion that extends laterally from said body portion and has a thickness in a direction perpendicular to the substrate which is less than that of the body portion in said direction;

wherein said body portion comprises first and second profile portions shaped for releasable interengagement with each other; and (c) securing said lengths of fastener to said substrate by:

initially attaching along the length thereof said flange portion of each said fastener length to said substrate so as to leave the respective body portion of said fastener length free for movement relative to said substrate, thereby forming respective combinations of said substrate and said zipper lengths in which said flanges of said lengths of fastener are attached thereto by said flanges only;

subsequently passing said combinations of said substrate and said fastener lengths between a pair of sealing jaws; and displacing said sealing jaws relative to each combination of said substrate and said fastener lengths to bring said substrate and said body portion of each fastener length into contact with each other to effect sealing of each said body portion to said substrate along the length of the body portion, whereby said body portions of said fastener lengths are no longer free for movement relative to said substrate and said fastener lengths are attached to said substrate by said flanges and said body portions thereof.

2. A method as claimed in claim 1, in which the length dimension of said sealing jaws is adapted to form said substrate around the respective body portion of each said fastener length.

3. A method as claimed in claim 1, in which said continuous elongate substrate is a first web of first and second substantially parallel webs of material, and said step of initially attaching said flange portions of said fastener lengths comprises attaching said flange portions to the surface of said first web of material facing said second web.

4. A method as claimed in claim 1, in which said flange portion of each said fastener length is a single flange extending from said body portion of the respective fastener length.

5. A method as claimed in claim 1, in which each said first and second profile portions of each said fastener length comprises an upstanding post at one lateral margin of the respective body portion, each said post contacting a heel at the opposite lateral margin of the other profile portion, the respective posts and heels being angled at their respective contact surfaces.

* * * * *